US010741935B2

(12) United States Patent
Hata et al.

(10) Patent No.: US 10,741,935 B2
(45) Date of Patent: Aug. 11, 2020

(54) BRANCH CONNECTOR

(71) Applicant: KYOCERA Corporation, Kyoto (JP)

(72) Inventors: Tetsuya Hata, Yokohama (JP); Shigeki Ohara, Isehara (JP)

(73) Assignee: KYOCERA Corporation, Kyoto (JP)

( * ) Notice: Subject to any disclaimer, the term of this patent is extended or adjusted under 35 U.S.C. 154(b) by 0 days.

(21) Appl. No.: 16/340,536

(22) PCT Filed: Oct. 2, 2017

(86) PCT No.: PCT/JP2017/035878
§ 371 (c)(1),
(2) Date: Apr. 9, 2019

(87) PCT Pub. No.: WO2018/070291
PCT Pub. Date: Apr. 19, 2018

(65) Prior Publication Data

US 2019/0296453 A1 Sep. 26, 2019

(30) Foreign Application Priority Data

Oct. 11, 2016 (JP) ..... 2016-200295

(51) Int. Cl.
*H01R 4/24* (2018.01)
*H01R 4/2433* (2018.01)
(Continued)

(52) U.S. Cl.
CPC ..... *H01R 4/2433* (2013.01); *H01R 4/24* (2013.01); *H01R 13/52* (2013.01); *H01R 31/06* (2013.01)

(58) Field of Classification Search
CPC ..... H01R 4/2433
(Continued)

(56) References Cited

U.S. PATENT DOCUMENTS 4,461,528 A * 7/1984 Durand ..... H01R 13/506 439/409
5,562,478 A * 10/1996 Yamamoto ..... H01R 4/2433 439/402
(Continued)

FOREIGN PATENT DOCUMENTS

JP 61-008952 U1 1/1986
JP H1116612 A 1/1999
(Continued)

*Primary Examiner* — Abdullah A Riyami
*Assistant Examiner* — Vladimir Imas
(74) *Attorney, Agent, or Firm* — Studebaker & Brackett PC

(57) ABSTRACT

A branch connector capable of maintaining a sealing state for cables with different specifications is provided. A branch connector (10) configured to electrically connect cables together by cutting insulating sheaths in press-contact grooves includes a pair of first split housing (16) and a second split housing (30) that are coupled together via a connecting portion and can open and close, first holding portions (29) that are provided to the first split housing (16) and configured to hold the cables, and second holding portions (40) that are provided to the second split housing (30) and configured to hold the cables. In a state in which the first split housing (16) and the second split housing (30) are fitted together, the first holding portions (29) and the second holding portions (40) are in different locations from each other with respect to an extending direction of the cables and a direction perpendicular to the extending direction.

6 Claims, 12 Drawing Sheets

(51) Int. Cl.
*H01R 31/06* (2006.01)
*H01R 13/52* (2006.01)

(58) Field of Classification Search
USPC ..... 439/400
See application file for complete search history.

(56) References Cited

U.S. PATENT DOCUMENTS 5,690,505 A * 11/1997 Hirata ..... H01R 4/2433 439/402
5,714,717 A 2/1998 Nakagome
5,759,065 A * 6/1998 Hatagishi ..... H01R 4/2433 439/404
5,762,517 A * 6/1998 Abe ..... H01R 4/2433 439/402
5,961,341 A * 10/1999 Knowles ..... H01R 4/2433 439/403
5,997,337 A 12/1999 Torii
6,111,201 A * 8/2000 Drane ..... H02G 15/18 174/92
6,208,233 B1 * 3/2001 Stein, Sr. ..... G01L 19/0084 338/195
6,299,472 B1 * 10/2001 Beukes ..... H01R 4/2433 439/403
6,769,931 B2 * 8/2004 Negishi ..... H01R 4/2433 439/402
7,448,900 B1 * 11/2008 Chen ..... H01R 4/2412 439/402
7,871,287 B2 * 1/2011 Hofmann ..... H01R 4/2458 439/417
8,215,980 B1 * 7/2012 Lin ..... H01R 4/2433 439/404
8,827,738 B2 * 9/2014 Lownds ..... H01R 4/2433 439/402
9,252,519 B2 * 2/2016 Mori ..... H01R 13/10
9,887,469 B1 * 2/2018 King, Jr. ..... H01R 4/2454
2006/0223360 A1 * 10/2006 Chiba ..... H01R 12/675 439/404

FOREIGN PATENT DOCUMENTS

JP H11-204192 A 7/1999
JP 3028988 B2 2/2000
JP 2605275 Y2 7/2000
JP 2000-322940 A 11/2000

* cited by examiner

BRANCH CONNECTOR

CROSS REFERENCE TO RELATED APPLICATION

This application claims priority to and the benefit of Japanese Patent Application No. 2016-200295 filed on Oct. 11, 2016, the entire contents of which are incorporated herein by reference.

TECHNICAL FIELD

The present disclosure relates to a branch connector configured to connect a cable (an electrical wire) to an existing cable (an electrical wire) coupled to an electronic device or an electric device.

BACKGROUND

This type of branch connector includes an insulating housing (made of a synthetic resin) and a conductive relay contact (made of a metal) held by the housing. The housing includes a first split housing, a second split housing, a connecting portion, and a locking portion that are integrally formed. The connecting portion is configured to releasably connect the first and second split housings. The locking portion is configured to maintain a contact state of the first split housing and the second split housing when the first split housing and the second split housing are in contact.

The relay contacts are roughly classified into two known types. One type is a relay contact that includes a press-contact groove configured to clamp an existing cable (electrical wire), and a crimp terminal configured to crimp another cable (electrical wire) different from the existing cable (electrical wire) (PTL 1). The other type is a relay contact that includes a pair of press-contact grooves arranged in parallel configured to clamp an existing cable (electrical wire) and another cable (electrical wire), respectively (PTL 2).

A relay contact of either type is held in one of the first split housing and the second split housing. To connect cables to the press-contact groove, the cables to be clamped are placed on the press-contact grooves (inlets) of the relay contact and, in this state, the other split housing is placed on and fitted to (the split housing that includes) the relay contact. Thus, the press-contact grooves of the relay contact cut the coating of the cables, and the core wires and the relay contact are electrically connected.

There is an increasing demand to provide a waterproof function to branch connectors as described above. In this respect, a configuration in which a filler such as a waterproof gel or a UV curable resin is mounted in the first split housing and the second split housing when the first split housing and the second split housing contact with each other may be conceived.

CITATION LIST

Patent Literature

PTL 1: Japanese Patent No. 3028988
PTL 2: Japanese Utility Model Registration No. 2605275

SUMMARY

Technical Problem

However, the waterproof function of conventional branch connectors are insufficient for the following reason. That is, the dimensions of the clamp portions of conventional branch connectors do not consider the specifications of the cables, and are the same for cables with different specifications. Accordingly, depending on the specification of the cable, a gap may be formed between the cable and the clamp portion, and guaranteeing an airtight seal is difficult.

The present disclosure aims to provide a branch connector capable of maintaining a sealing state when connecting cables with different specifications together.

Solution to Problem

In order to solve the above problem, a branch connector according to a first aspect is a branch connector configured to electrically connect cables by cutting an insulating sheath using press-contact grooves. The branch connector includes a pair of a first split housing and a second split housing that are coupled together via a connecting portion and capable of opening and closing, first holding portions that are provided to the first split housing and configured to hold the cables, and second holding portions that are provided to the second split housing and configured to hold the cables. In a state in which the first split housing and the second split housing are fitted together, locations of the first holding portions and locations of the second holding portions are different from each other with respect to an extending direction of the cables and a direction perpendicular to the extending direction.

In the branch connector according to a second aspect, in a state in which the first split housing and the second split housing are fitted together, the first holding portions hold the cables in a first direction such that first gaps are formed on an opposite side of the cables in the first direction, and the second holding portions hold the cables in a second direction such that second gaps are formed on an opposite side of the cables in the second direction.

In the branch connector according to a third aspect, the first direction is opposite to a pressing direction for pressing the cables against the press-contact grooves, and the second direction is the pressing direction.

In the branch connector according to a fourth aspect, in a state in which the first split housing and the second split housing are fitted together, the cables are bent from portions near the first holding portions to portions near the second holding portions in the pressing direction further than contact points between the cable and the press-contact grooves.

In the branch connector according to a fifth aspect, in a state in which the first split housing and the second split housing are fitted together, the contact points, the second holding portions, and the first holding portions are arranged in the stated order in the pressing direction.

In the branch connector according to a sixth aspect, in a state in which the first split housing and the second split housing are fitted together, the second holding portions are located on outside of the first holding portions with respect to the extending directions.

A branch connector according to a seventh aspect further includes a relay contact having the press-contact grooves. In a state in which the first split housing and the second split housing are fitted together, each of a filler provided in the first split housing and a filler provided in the second split housing is located between the relay contact and the first holding portions.

Advantageous Effect

The present disclosure can provide a branch connector that is capable of maintaining a sealing state when coupling cables with different specifications together.

DETAILED DESCRIPTION

Hereinafter, an embodiment will be described with reference to the accompanying drawings. First, a structure of a branch connector which is not loaded with a filler will be mainly described. In the following description, a front-rear direction, a left-right direction, and an up-down direction are based on the directions of the arrows in the figures.

Figure 1:
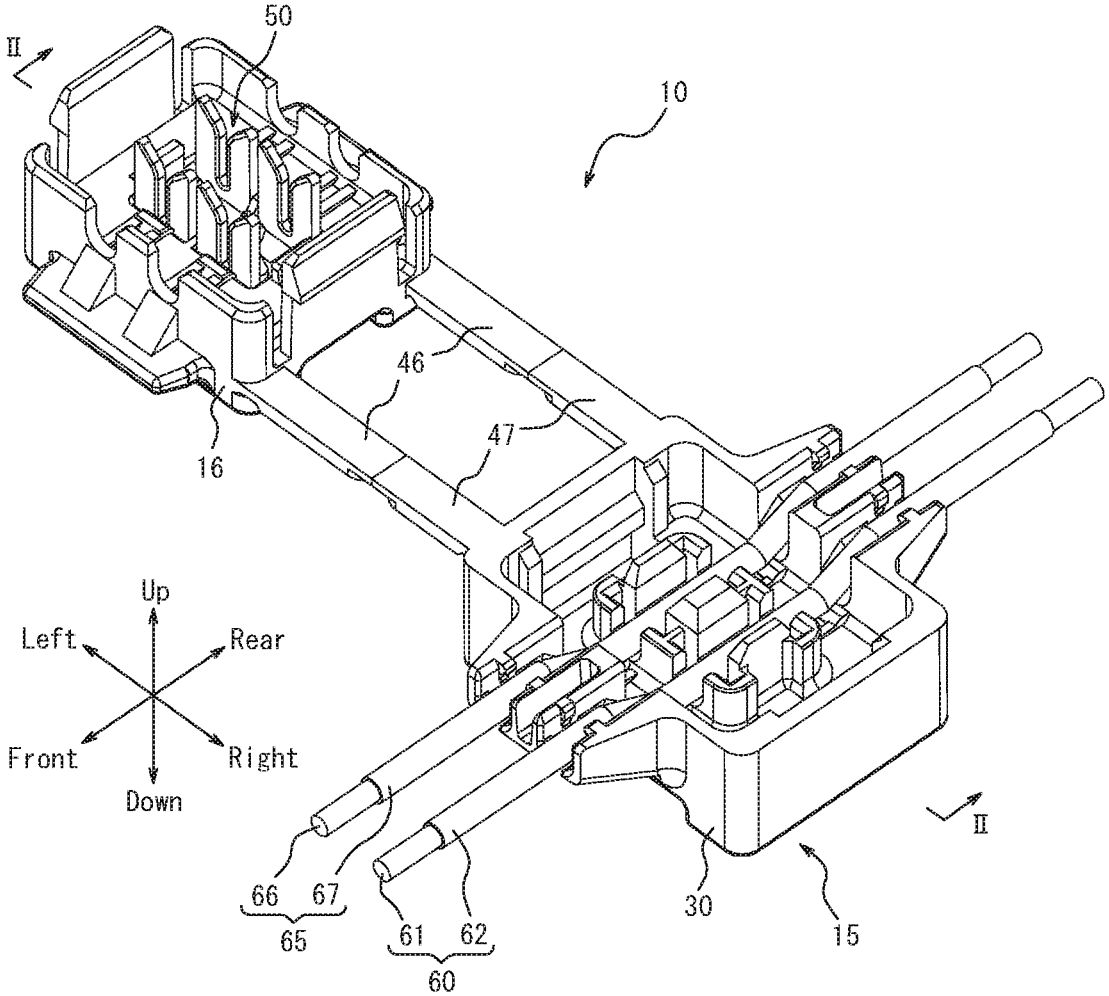
FIG. 1 is a perspective view illustrating a first cable, a second cable, and a branch connector that includes an insulating housing in an expanded state according to a first embodiment.
Figure 2:
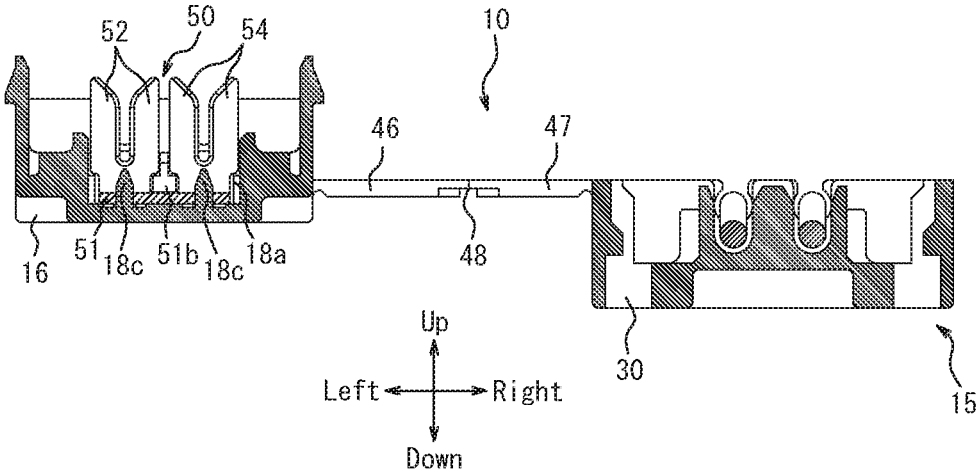
FIG. 2 is a cross-sectional view taken from arrow II-II of FIG. 1.

FIG. 1 is a perspective view illustrating a first cable 60, a second cable 65, and a branch connector 10, in which an insulating housing 15 according to the present embodiment is in an expanded state. FIG. 2 is a cross-sectional view taken from arrow II-II of FIG. 1. The branch connector 10 according to the present embodiment includes the insulating housing 15 and a relay contact 50 as main elements.

The insulating housing 15 is obtained by, for example, molding a synthetic resin material having an insulating property. The insulating housing 15 includes a first split housing 16, a second split housing 30, and a pair of first connecting portions 46 and a pair of second connecting portions 47 which are configured to couple the first split housing 16 and the second split housing 30 together. The first split housing 16, the second split housing 30, the pair of first connecting portions 46, and the pair of second connecting portions 47 are integrally formed.

Figure 3:
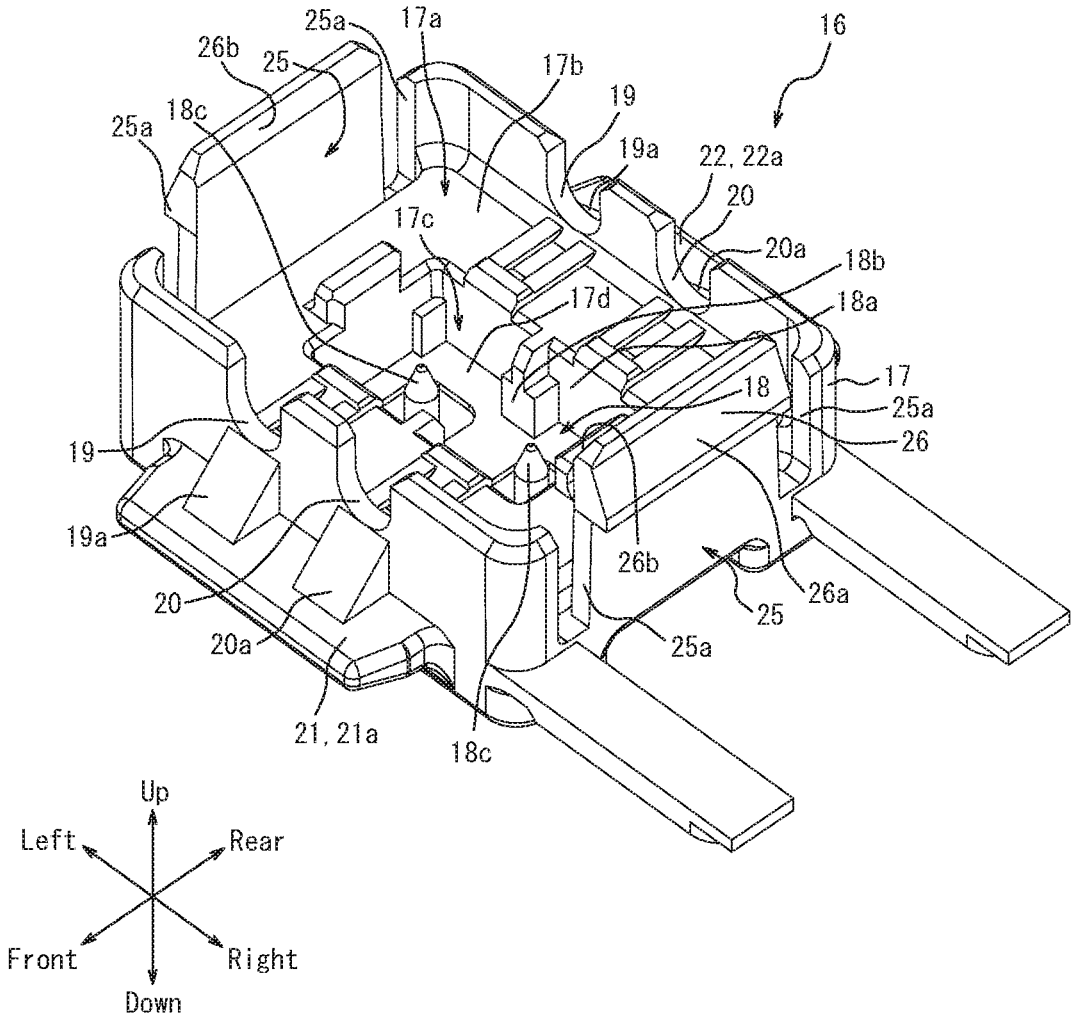
FIG. 3 is an enlarged perspective view illustrating a first split housing alone, omitting a relay contact.

FIG. 3 is a perspective view illustrating a magnified view of the first split housing 16 alone, omitting the relay contact 50. The structure of the first split housing 16 will be described in detail with reference to FIG. 3.

An outer peripheral edge of one surface (an upper surface in FIG. 3) in a thickness-direction of the first split housing 16 is formed by an outer peripheral wall 17. In the first split housing 16, the inside of the outer peripheral wall 17 is configured as an inner recess 17*a* recessed (downward in FIG. 3) stepwise from the top surface of the first split housing 16. The bottom surface (an upper surface in FIG. 3) of the inner recess 17*a* includes an inner circumferential first opposing surface 17*b* configured as a plane parallel to the top surface of the first split housing 16. The central portion located on the inner circumferential side of the inner circumferential first opposing surface 17*b* is configured as a first central recess 17*c* recessed (downward in FIG. 3) stepwise from the inner circumferential first opposing surface 17*b*. The bottom surface of the first central recess 17*c* (an upper surface in FIG. 3) includes a first central opposing surface 17*d* configured as a plane parallel to the inner circumferential first opposing surface 17*b*. The first central recess 17*c* and the first central opposing surface 17*d* constitute a contact mounting groove 18. The contact mounting groove 18 includes a fixing portion 18*a* and a central projection 18*b*, which is located at the center of the fixing portion 18*a* with respect to the left-right direction and configured to narrow the front-rear direction width of the fixing portion 18*a* while separating the fixing portion 18*a* into a pair of portions in the left-right direction. Each of the bottom surfaces of the portions of the fixing portion 18*a* (the first central opposing surface 17*d*) is provided with a positioning protrusion 18*c* having a substantially cylindrical shape.

The outer peripheral wall 17 of the first split housing 16 includes a pair of first cable mounting grooves 19 configured as cutouts linearly arranged on the front and rear sides of one of the fixing portions 18*a*. The outer peripheral wall 17 also includes a pair of second cable mounting grooves 20 configured as cutouts linearly arranged (parallel to the first cable mounting grooves 19) on the front and rear sides of the other fixing portion 18*a*. Each of the first cable mounting grooves 19 and each of the second cable mounting grooves 20 has a semi-circular shape in a plan view. On the front and rear surfaces of the outer peripheral wall 17 of the first split housing 16, a pair of inclined surfaces 19*a* are provided inclining outward in the downward direction from the bottoms of the pair of first cable mounting grooves 19. Similarly, on the front and rear surfaces of the outer peripheral wall 17 of the first split housing 16, a pair of inclined surfaces 20*a* are provided inclining outward in the downward direction from the bottoms of the pair of second cable mounting grooves 20. The front surface and the rear surface of the outer peripheral wall 17 of the first split housing 16 are provided with a cover portion 21 and a cover portion 22, respectively. The cover portion 21 has a flat-plate shape extending in the front direction from under the inclined surfaces 19*a* and 20*a*, and the cover portion 22 has a flat-plate shape extending in the rear direction from under the inclined surfaces 19*a* and 20*a*. The opposing surface 21*a* of the cover portion 21 and the opposing surface 22*a* of the cover portion 22 (upper surfaces in FIG. 3) are flush with the bottom of the inclined surface 19*a* and the inclined surface 20*a*.

The left and right side surfaces of the outer peripheral wall 17 of the first split housing 16 are provided with a pair of first locking portions 25 having resiliency. A pair of cutouts 25*a* is formed between the first locking portion 25 and the front and rear surfaces of the outer peripheral wall 17. Each of the pair of first locking portions 25 is provided with a first locking protrusion 26 that protrudes outward from the side surface of the first split housing 16. The first locking protrusions 26 extends in the front-rear direction. The first locking protrusions 26 include an inclined surface 26*a* that is inclined to the outside of the first split housing 16 in the downward direction. Each of the pair of first locking portions 25 is provided with an inclined surface 26*b* that is formed on the top edge of the inner surface of each of the pair of first locking portions 25 and inclined to the inside of the first split housing 16 in the downward direction.

Figure 4:
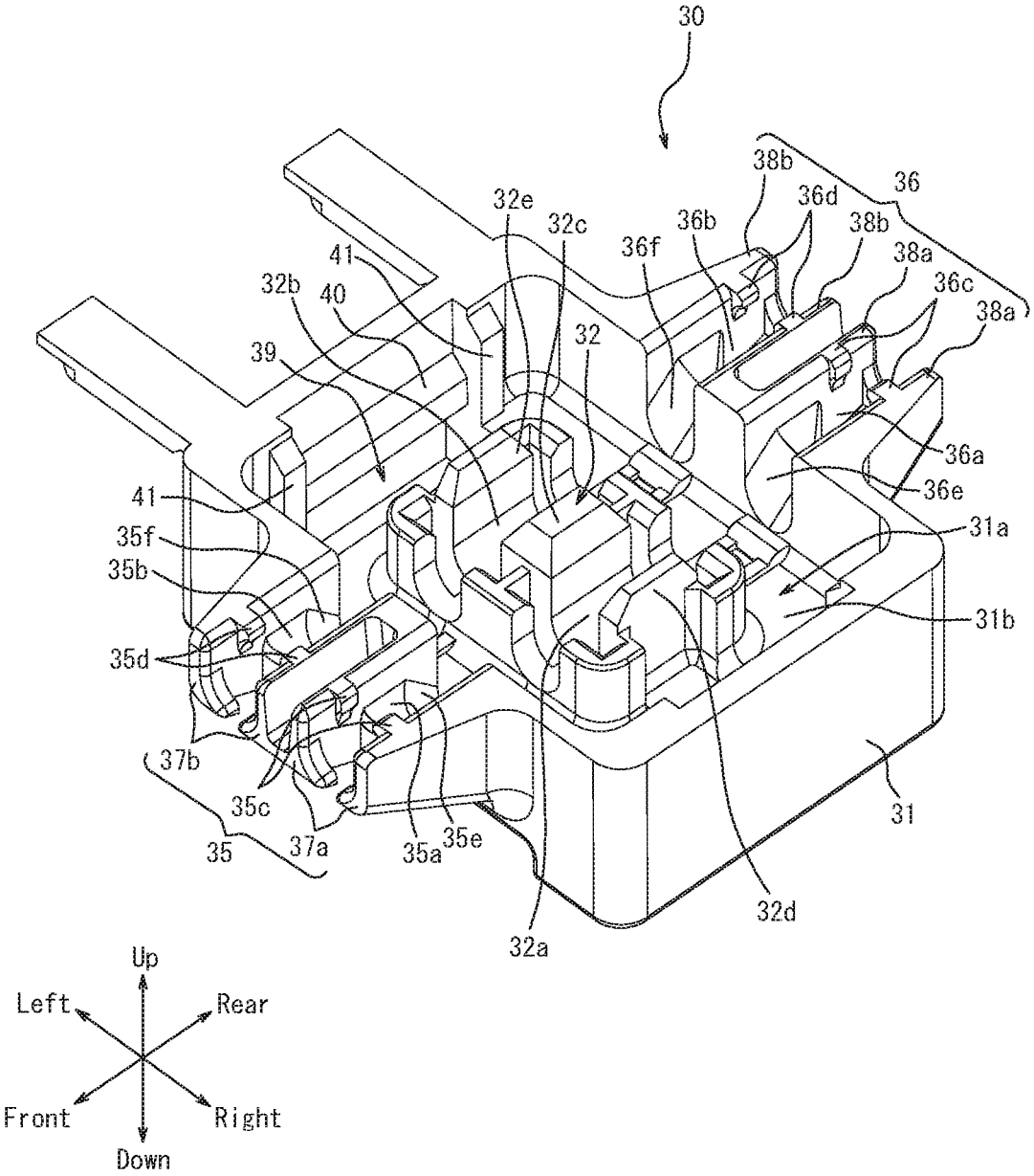
FIG. 4 is an enlarged perspective view of a second split housing alone.

FIG. 4 is an enlarged perspective view of the second split housing 30 alone. The structure of the second split housing 30 will be described in detail with reference to FIG. 4.

An outer peripheral edge of one surface (an upper surface in FIG. 4) in a thickness-direction of the second split housing 30 is formed as a protrusion by an outer peripheral wall 31. In the second split housing 30, the inside of the outer peripheral wall 31 is configured as an inner recess 31*a* that is recessed stepwise from the outer peripheral wall 31. One of the surfaces (a bottom surface) of the inner peripheral recess 31*a* includes an inner circumferential second opposing surface 31*b* configured as a flat plane parallel to the top surface of the second split housing 30. The inner circumferential second opposing surface 31*b* is provided with a cable pressing protrusion 32 that includes a pair of a first pressing groove 32*a* and a second pressing groove 32*b* having U-shapes in cross-sections arranged in the left-right direction. The cable pressing protrusion 32 includes a central protrusion 32*c* and a protrusion 32*d* and a protrusion 32*e* arranged on the right side and the left side, respectively, of the central protrusion 32*c*. The first pressing groove 32*a* is formed between the central protrusion 32*c* and the protrusion 32*d*. The second pressing groove 32*b* is formed between the central protrusion 32*c* and the protrusion 32*e*.

The second split housing 30 includes a cable supporting arm 35 protruding from the front surface of the second split housing 30 and a cable supporting arm 36 protruding from the rear surface. The top surface of the cable supporting arm 35 (the upper surface in FIG. 4) includes a first cable holding groove 35*a* and a second cable holding groove 35*b*, and the top surface of the cable supporting arm 36 includes a first cable holding groove 36*a* and a second cable holding groove 36*b*. The cable supporting arm 35 located on the front side is provided with a pair of protruding members 37*a* spaced apart from each other in the left-right direction in the front edge portion of the first cable holding groove 35*a* (on the front side in FIG. 4), and the cable supporting arm 36 located on the rear side is provided with a pair of protruding members 38*a* spaced apart from each another in the left-right direction in the rear edge portion of the first cable holding groove 36*a* (on the rear side in FIG. 4). Similarly, the cable supporting arm 35 located on the front side is provided with a pair of protruding members 37*b* spaced apart from each other in the left-right direction in the front edge portion of the second cable holding groove 35*b* (on the front side in FIG. 4), and the cable supporting arm 36 located on the rear side is provided with a pair of protruding members 38*b* spaced apart from each other in the left-right direction in the rear edge portion of the second cable holding groove 36*b* (on the rear side in FIG. 4). Each of the pair of protruding members 37*a*, the pair of protruding members 38*a*, the pair of protruding members 37*b*, and the pair of protruding members 38*b*, particularly those located on the left and right outer sides, is elastically bent in the left-right direction and the spacing from its adjacent protrusion is changeable. Each of the pair of protruding members 37*a* and the pair of protruding members 37*b* includes a pair of claws opposing each other formed at the lower front edge. Also, each of the pair of protruding members 38*a* and the pair of protruding members 38*b* includes a pair of claws opposing each other formed at the lower rear edge.

Each of the first cable holding grooves 35*a* and 36*a* and each of the second cable holding grooves 35*b* and 36*b* has a depth sufficient for insertion and retention (to accommodate) of the entire diameter of the first cable 60 and the second cable 65. The first cable holding grooves 35*a* and 36*a* include inclined surfaces 35*e* and 36*e*, respectively, which are inclined upward in the outward directions. That is, when the first cable 60 is inserted into and held by the first cable holding grooves 35*a* and 36*a*, portions of the first cable 60 corresponding to the inclined surface 35*e* of the first cable holding groove 35*a* and the inclined surface 36*e* of the first cable holding groove 36*b* are inclined obliquely in the up-down direction along the inclined surfaces. Similarly, the second cable holding grooves 35*b* and 36*b* include inclined surfaces 35*f* and 36*f*, respectively. The second cable 65 is inserted into and held by the second cable holding grooves 35*b* and 36*b* in a manner similar to the first cable 60.

A pair of retainer protrusions 35*c* is provided to the first cable retaining groove 35*a* in the vicinity of a top opening of a front end portion (on the opposing surfaces provided with the pair of protruding members 37*a*), and a pair of retainer protrusions 36*c* is provided to the first cable retaining groove 36*a* in the vicinity of a top opening of a rear end portion (on the opposing surfaces provided with the pair of protruding members 38*a*). Similarly, a pair of retainer protrusions 35*d* is provided to the second cable retaining groove 35*b* in the vicinity of a top opening of a front end portion (on the opposing surfaces provided with the pair of protruding members 37*b*), and a pair of retainer protrusions 36*d* is provided to the second cable retaining groove 36*d* in the vicinity of a top opening of a rear end portion (on the opposing surfaces provided with the pair of protruding members 38*b*). The retainer protrusions 35*c* and 36*c* allow insertion of the first cable 60 into the first cable holding grooves 35*a* and 36*a*, respectively. The retainer protrusions 35*d* and 36*d* allow insertion of the second cable 65 into the second cable holding grooves 35*b* and 36*b*, respectively. At the time of the insertion, each of the pair of protruding members 37*a*, the pair of protruding members 38*a*, the pair of protruding members 37*b*, and the pair of protruding members 38*b* is bent such that the gaps therebetween (i.e., the gap between the pair of retainer protrusions 35*c*, the gap between the pair of retainer protrusions 36*c*, the gap between the pair of retainer protrusions 35*d*, and the gap between the pair of retainer protrusions 36*d*) are widened in the left-right direction.

When the first cable 60 and the second cable 65 are inserted into the first cable holding grooves 35*a* and 36*a* and the second cable holding grooves 35*b* and 36*b*, respectively, each of the pair of retainer protrusions 35*c* and the pair of retainer protrusions 36*c* clamp the first cable 60, and each of the pair of retainer protrusions 35*d* and the pair of retainer protrusions 36*d* clamp the second cable 65. Each of the pair of protruding members 37*a*, the pair of protruding members 38*a*, the pair of protruding members 37*b*, and the pair of protruding members 38*b* is elastically bent in directions which narrow the space therebetween in the left-right direction. Thus, the pair of retainer protrusions 35*c* and the pair of retainer protrusions 36*c* allow, in a resisting manner, a cable-extending-direction movement of the first cable 60 inserted into the first cable holding grooves 35*a* and the first cable holding grooves 36*a*, respectively. Also, the pair of retainer protrusions 35*d* and the pair of retainer protrusions 36*d* allow, in a resisting manner, a cable-extending-direction movement of the second cable 65 inserted into the second cable holding grooves 35*b* and the second cable holding grooves 36*b*, respectively. Each of the pair of retainer protrusions 35*c* and the pair of retainer protrusions 36*c* functions as a stopper configured to resist a force acting to remove the first cable 60 from the first cable holding grooves 35*a* and 36*a* and inhibit easy removal of the first cable 60. Also, each of the pair of retainer protrusions 35*c* and the pair of retainer protrusions 36*c* functions as a stopper configured to resist a force acting to remove the second cable 65 from the second cable holding grooves 35*b* and 36*b* and inhibit easy removal of the second cable 65. Each of the pair of retainer protrusions 35*c* and the pair of retainer protrusions 36*c* allows removal of the first cable 60 upon application of an external force of a certain strength or greater. Each of the pair of retainer protrusions 35*d* and the pair of retainer protrusions 36*d* allows removal of the second cable 65 upon application of an external force of a certain strength or greater. Such retaining actions as described above are maintained even when the second split housing 30 is flipped over (interchange of inside and outside).

The left and right side surfaces of the outer peripheral wall 31 of the second split housing 30 includes a pair of second locking portions 39. The pair of second locking portion 39 are formed on the inner surface of the second split housing 30. Each of the pair of second locking portions 39 includes a second locking protrusion 40 that protrudes inward from the side surface of the second split housing 30. Each of the second locking portions 39 includes a pair of convex walls 41 extending in the up-down direction at the front and rear ends of the respective second locking portions 39. Each of the second locking protrusions 40 has a substantially rectangular parallelepiped shape formed on the inner surface of the second split housing 30 and extends between the pair of convex walls 41. That is, the second locking protrusions 40 extend in the front-rear direction.

Figure 5:
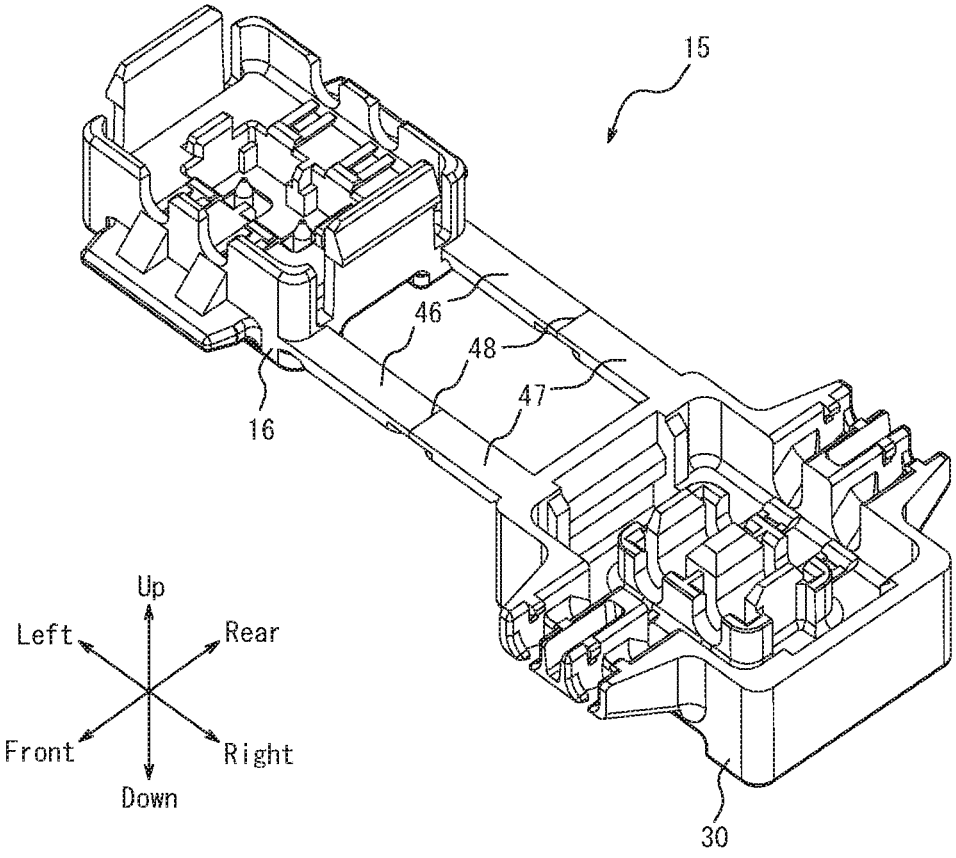
FIG. 5 is a perspective view illustrating the insulating housing in its entirety, omitting the relay contact.

FIG. 5 is a perspective view illustrating the insulating housing 15 in its entirety, omitting the relay contact 50.

The first split housing 16 and the second split housing 30 are coupled together via the pair of first connecting portions 46 that is arranged in the front-rear direction and linearly extends from the first split housing 16, a pair of second connecting portions 47 that is arranged in the front-rear direction and linearly extends from the second split housing 30, and a pair of fold-facilitating portions 48. The fold-facilitating portion 48 couples the pair of first connecting portions 46 and the pair of second connecting portions 47 together. The pair of first connecting portions 46 and the pair of second connecting portions 47 are located on the same plane in the expanded state.

The fold-facilitating portions 48 are thinner than the first connecting portion 46 and the second connecting portion 47 arranged in the front-rear direction, as illustrated in FIG. 2 and FIG. 5. Each of the pair of first connecting portions 46 and the pair of second connecting portions 47 arranged in the front-rear direction can be (easily) folded at the fold-facilitating portions 48 that extend in the front-rear direction and serve as a folding line for valley-folding (i.e., in a folding manner to bring the first split housing 16 and the second split housing 30 close to each other) in FIG. 1, FIG. 5, and so on. The pair of first connecting portions 46 has flexural rigidity smaller than that of the pair of second connecting portions 47.

Each of the first split housing 16, the pair of first connecting portions 46, the fold-facilitating portions 48, the pair of second connecting portions 47, and the second split housing 30 has strength (rigidity) sufficient to autonomously maintain the expanded state illustrated in FIG. 1 and FIG. 5.

Figure 6:
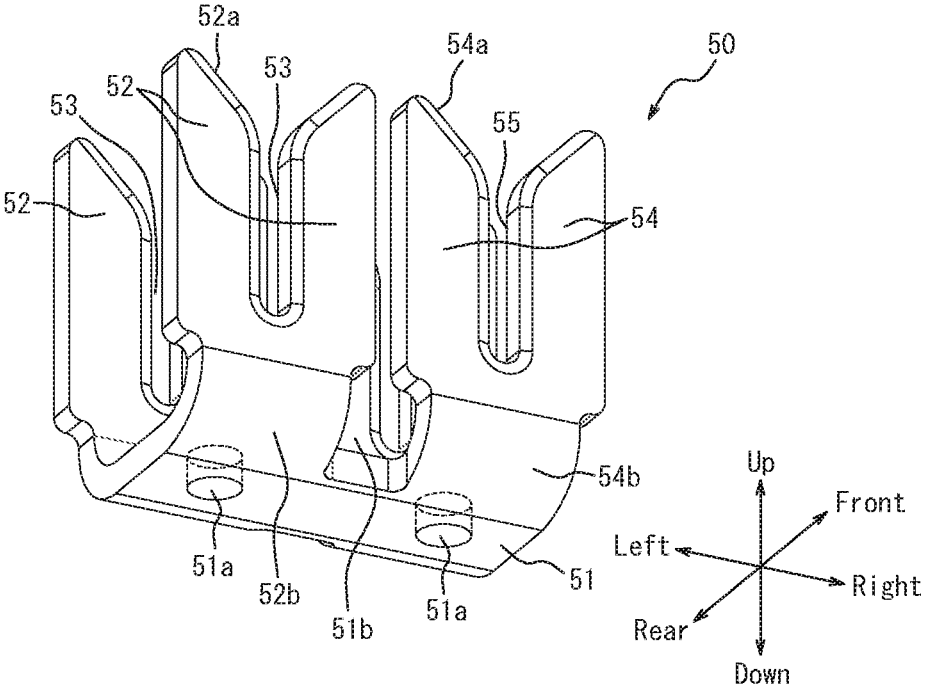
FIG. 6 is a perspective view illustrating the relay contact alone.

FIG. 6 is a perspective view illustrating the relay contact 50 alone. A configuration of the relay contact 50 will be described in detail with reference to FIG. 6.

The relay contact 50 is formed by processing of a thin plate made of a copper alloy (e.g., phosphor bronze, beryllium copper, or titanium copper) or Corson copper alloy into a shape as illustrated in the figure by using a progressive die (stamping). The relay contact 50 is plated with copper-tin alloy or tin (or gold) after nickel plate undercoating.

The relay contact 50 includes a base 51 that has a plate-like shape and extends in the left-right direction, a pair of first cable clamp members 52 each having a plate-like shape that protrudes from the front and rear edges on one side of the base 51 and extends in a direction perpendicular to the base 51, and a pair of second cable clamp members 54 each having a plate-like shape that protrudes from the front and rear edges on the other side of the base 51 and extends in a direction perpendicular to the base 51. The base 51, the pair of first cable clamp members 52, and the pair of second cable clamp members 54 are integrally formed. The base 51 includes a pair of positioning holes 51*a* having a circular shape in the left and right portions of the base 51. Each of the pair of first cable clamp member 52 and each of the pair of second cable clamp members 54 arranged in the front-rear direction includes a first press-contact groove 53 and a second press-contact groove 55, respectively, configured as slits linearly extending toward the base 51. Each of the pair of first press-contact grooves 53 includes, at the top opening thereof, a top end portion 52*a* having a substantially V-shape opening upward. Each of the pair of second press-contact grooves 55 includes, at the top opening thereof, a top end portion 54*a* having a substantially V-shape opening upward.

The pair of first cable clamp members 52 and the pair of second cable clamp members 54 are coupled to the base 51 via narrow portions (neck portions) 52*b* and narrow portions (neck portions) 54*b*, respectively. The spaces between the opposing edges of the pair of first cable clamp members 52 and the pair of second cable clamp members 54 arranged in the left-right direction are narrower than the spaces between the opposing edges of the narrow portions 52*b* and the narrow portions 54*b*. A space 51*b* is formed between the narrow portion 52*b* and the narrow portion 54*b*. No other members, such as an insulator, are provided between the pair of first cable clamp members 52 and the pair of second cable clamp members 54.

The relay contact 50 is configured to electrically connect the first cable 60 and the second cable 65.

The first cable 60 is formed from a core wire 61 (stranded wires or a single wire) made of a material (e.g., copper or aluminum) that has conductivity and flexibility, which is covered by a sheath 62 having a tubular shape that has conductivity and insulating properties. Similarly, the second cable 65 is constituted of a core wire 66 (stranded wires or a single wire) made of a material (e.g., copper or aluminum) that has conductivity and flexibility, which is covered by a sheath 67 having a tubular shape that has conductivity and insulating properties. The first cable 60 is an original wire in a wiring object (e.g., an automobile or the like) configured to be connected to a power source of the wiring object. The second cable 65 is a cable additionally connected to the first cable 60. A (front) end of the second cable 65 is connected to an electronic device or an electrical device (e.g., a car navigation system).

Figure 7:
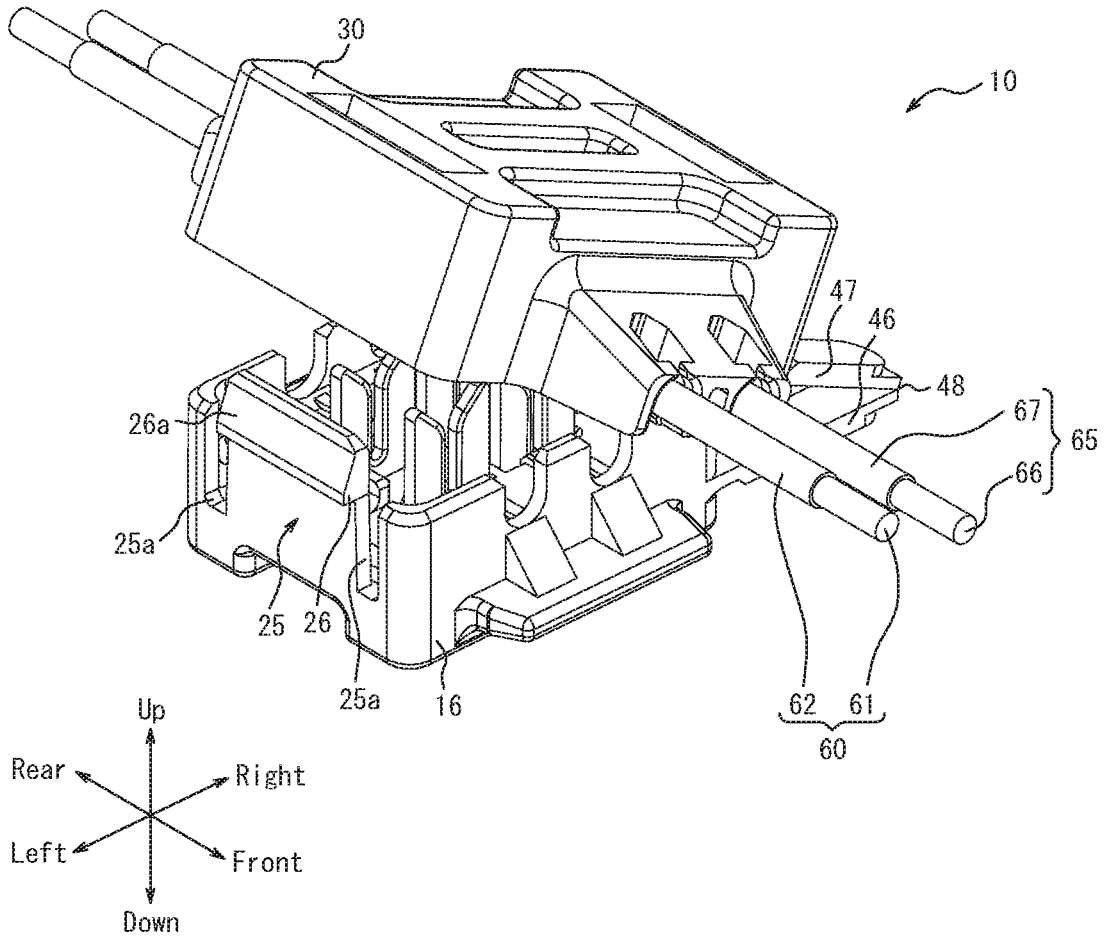
FIG. 7 is a perspective view illustrating the branch connector, the first cable, and the second cable in transition from the expanded state to a locked state.
Figure 8:
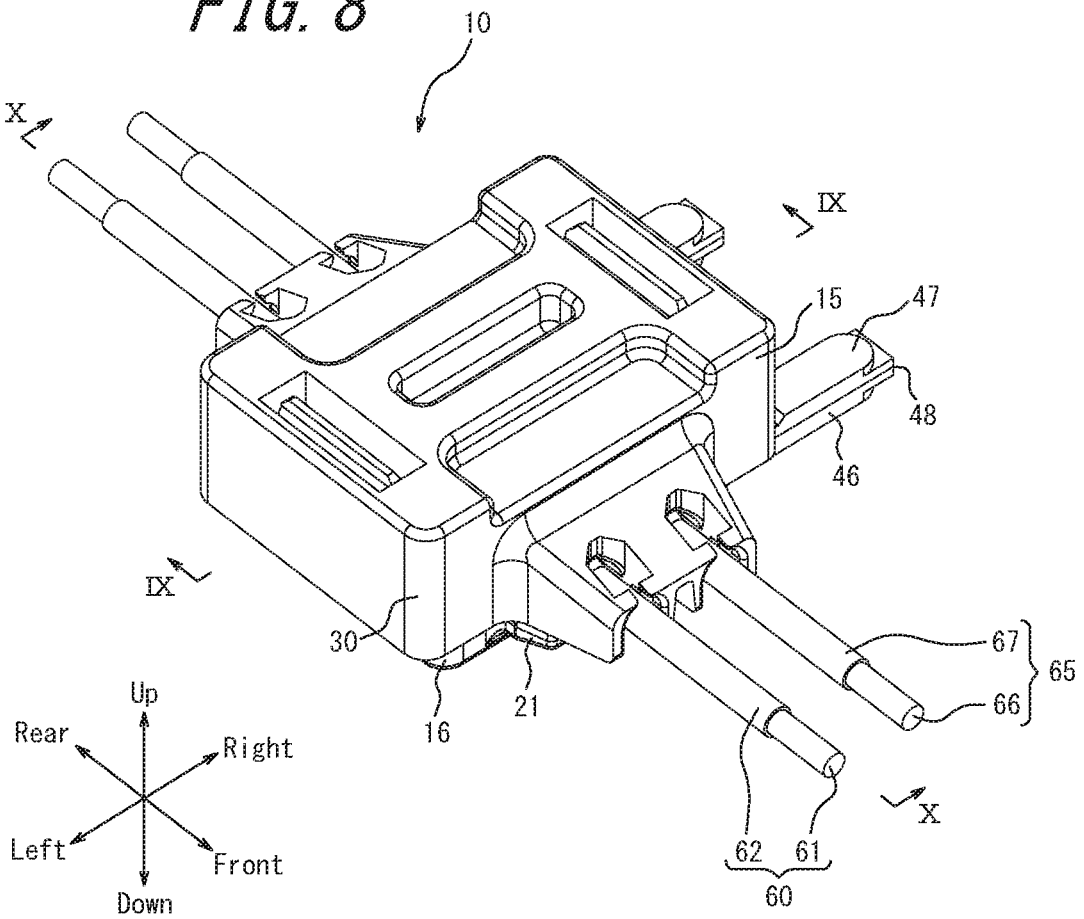
FIG. 8 is a perspective view illustrating the branch connector, the first cable, and the second cable in the locked state.
Figure 9:
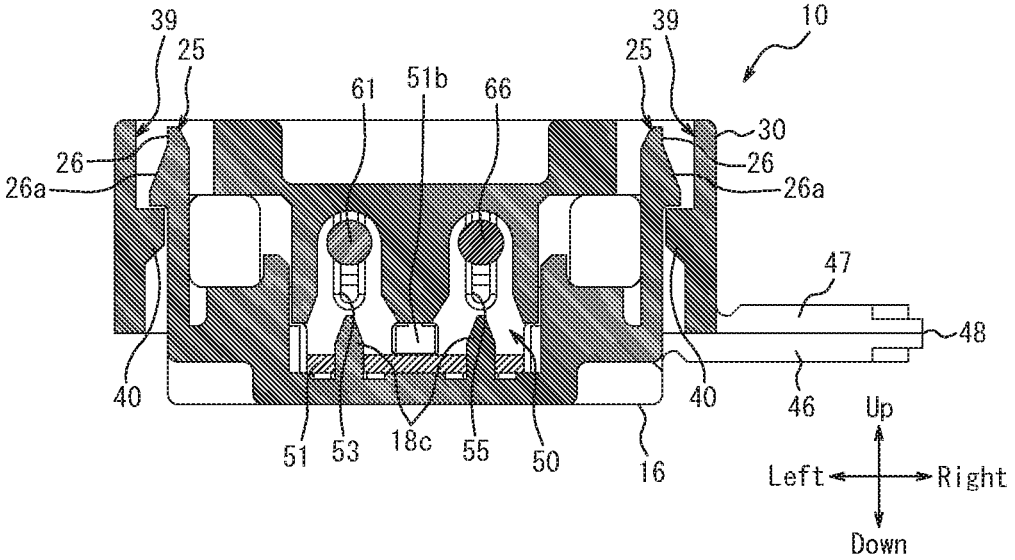
FIG. 9 is a cross-sectional view taken from arrow IX-IX of FIG. 8.
Figure 10:
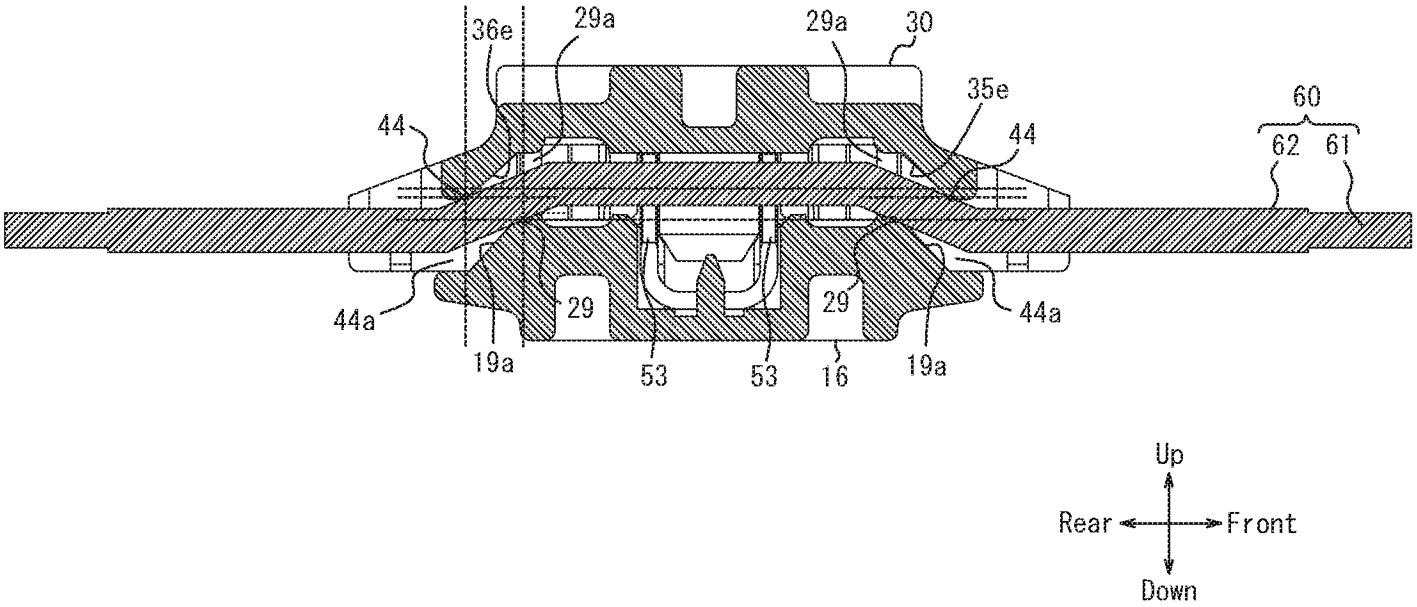
FIG. 10 is a cross-sectional view taken from arrow X-X of FIG. 8.

FIG. 7 is a perspective view illustrating the branch connector 10, the first cable 60, and the second cable 65 in transition of the insulating housing 15 from the expanded state to a locked state. FIG. 8 is a perspective view illustrating the branch connector 10, the first cable 60, and the second cable 65 when the insulating housing 15 is in the locked state. FIG. 9 is a cross-sectional view taken along arrow IX-IX of FIG. 8. FIG. 10 is a cross-sectional view taken along arrow X-X of FIG. 8.

In order to assemble the branch connector 10 by integrating the insulating housing 15, the relay contact 50, the first cable 60, and the second cable 65 and electrically connecting the first cable 60 and the second cable 65, an assembling operator manually fits the lower portion of the relay contact 50 to the contact mounting groove 18 of the first split housing 16 in the expanded state illustrated in FIG. 1 and FIG. 5. In particular, the base 51 is fitted to the bottom portion of the contact mounting groove 18 in such a manner that the space 51*b* accommodates the central protrusion 18*b*. Each of the half portions of the first cable clamp members 52 close to the base 51 (the lower portions in FIG. 1 and FIG. 2) is fitted to a corresponding portion of the fixing portion 18*a*. Each of the half portions of the second cable clamp members 54 close to the base 51 is fitted to a corresponding portion of the fixing portion 18*a*. Because the pair of positioning protrusions 18*c* of the first split housing 16 is fitted into the pair of positioning holes 51*a* of the base 51 (see FIG. 2 and FIG. 9), the contact 50 is positioned relative to the first split housing 16. When the relay contact 50 is mounted in the first split housing 16, the first press-contact grooves 53 arranged in the front-rear direction are positioned on the axis extending through the pair of first cable mounting grooves 19 arranged in the front-rear direction and, simultaneously, the second press-contact grooves 55 arranged in the front-rear direction are positioned on the axis extending through the pair of second cable mounting grooves 20 arranged in the front-rear direction.

The assembling operator manually pushes the first cable 60 and the second cable 65 in a manner overcoming the resistance of the retainer protrusions 35*c* and 36*c* arranged in the front-rear direction and the retainer projections 35*d* and 36*d* arranged in the front-rear direction (see FIG. 1). At this time, the pair of protruding members 37*a*, the pair of protruding members 38*a*, the pair of protruding members 37*b*, and the pair of protruding members 38*b* are elastically bent in a such a manner as to widen the space between the pair of retainer protrusions 35*c*, the space between the pair of retainer protrusions 36*c*, the space between the pair of retainer protrusions 35*d*, and the space between the pair of retainer protrusions 36*d*, respectively. When the first cable 60 and second cable 65 are pushed into the first cable holding grooves 35*a* and 36*a* and the second cable holding grooves 35*b* and 36*b*, respectively, the space between the retainer protrusions 35*c*, the space between the retainer protrusions 36*c*, the space between the retainer protrusions 35*d*, and the space between the retainer protrusions 36*d* is restored. Thus, the first cable 60 is clamped between the bottom of the first cable holding grooves 35*a* and 36*a* and the retainer protrusions 35*c* and 36*c*, and the second cable 65 is clamped between the bottom of the second cable holding grooves 35*b* and 36*b* and the retainer protrusions 35*d* and 36*d*. This enables the first cable 60 and the second cable 65 to move in the cable extending direction in a resisting manner. Thus, positions of the first cable 60 and the second cable 65 can be adjusted in the extending directions thereof relative to the branch connector 10 in the expanded state illustrated in FIG. 1 and FIG. 2. Upon application of a force acting to remove the first cable 60 from the first cable holding grooves 35*a* and 36*a* or a force acting to remove the second cable 65 from the second cable holding grooves 35*b* and 36*b*, the corresponding one of first cable 60 and the second cable 65 receives a resisting force inhibiting the removal thereof. Thus, even when the branch connector 10 is flipped upside down, the first cable 60 and the second cable 65 do not easily fall out of the first cable holding grooves 35*a* 36*a* and the second cable holding grooves 35*b* and 36*b*, respectively. The first cable 60 and the second cable 65 can be removed from the first cable holding grooves 35*a* and 36*a* and the second cable holding grooves 35*b* and 36*b*, respectively, upon application of an urging force of a certain strength or greater. This facilitates replacement of the branch connector 10 and changes of the first cable 60 and the second cable 65 to be mounted in or dismounted from the branch connector 10.

In a state in which the first cable 60 and the second cable 65 are arranged in the left-right direction and fitted to the first cable holding grooves 35*a* and 36*a* and the second holding grooves 35*b* and 36*b*, respectively, the second split housing 30 (the pair of second connecting portions 47 arranged in the front-rear direction) is rotated toward the first split housing 16 (the pair of first connecting portions 46 arranged in the front-rear direction) in a manner pivoting around the fold-facilitating portions 48 arranged in the front-rear direction. This causes each of the second locking protrusions 40 of the first split housing 16 to contact a corresponding one of the inclined surfaces 26*a* of the first locking protrusions 26. When the second split housing 30 is further rotated, each of the second locking protrusions 40 slides downward on a corresponding one of the inclined surfaces 26*a*, and the first locking protrusions 26 are elastically deformed inward into the first split housing 16. The second pressing groove 32*b* of the cable pressing protrusion 32 on the side close to the second connecting portion 47 slightly pushes the central portion of the second cable 65 (in the downward direction) toward the bottom of the second press-contact groove 55. This moves the central portion of the second cable 65 into the space between each of the pair of second cable clamp members 54 arranged in the front-rear direction.

The assembling operator manually rotates the second split housing 30 further toward the first split housing 16 in a manner pivoting around the fold-facilitating portions 48 arranged in the front-rear direction. The first pressing groove 32*a* of the cable pressing protrusion 23 located on a side remote from the second connecting portions 47 pushes the central portion of the first cable 60 against the top end portions 52*a* of the first cable clamp members 52 in the extending direction of the first press-contact grooves 53 or in a direction close thereto. In this way, the first cable 60 is clamped by the top end portions 52*a* and the cable pressing protrusion 32.

After the first cable 60 and the second cable 65 are placed on the top end portion 52*a* and the top end portion 54*a*, respectively, of the relay contact 50, the first split housing 16 and the second split housing 30 are pushed together in substantially parallel directions bringing them close to each other by a generic tool (e.g., pliers), which is not illustrated.

Each of the second locking protrusions 40 is engaged with a corresponding one of the first locking protrusions 26. Each of the convex walls 41 of the second locking portion 39 is fitted in a corresponding one of the recesses 25*a*. In this way, the first split housing 16 is fitted into the second split housing 30, and the first locking portions 25 and the second locking portions 39 are engaged with one another inside the first split housing 16 and the second split housing 30 fitted together.

The cable pressing protrusion 32 further pushes the central portions of the first cable 60 and the second cable 65 deep into (toward the bottoms of) the first press-contact groove 53 and the second press-contact groove 55, respectively. This moves the first cable 60 substantially to the central portions of the first press-contact grooves 53 from the top end portions 52*a*, and the second cable 65 substantially to the central portions of the second press-contact grooves 55 from the top end portions 54*a*. At this time, the first cable 60 and the second cable 65 are pressed by the first pressing groove 32*a* and the second pressing groove 32*b*, respectively, of the cable pressing protrusion 32 in directions substantially parallel to each other in the up-down direction (i.e., the extending directions of the first press-contact groove 53 and the second press-contact groove 55). Thus, the inner surfaces (left and right surfaces) of the first press-contact groove 53 cut through the left and right side portions of the sheath 62 of the first cable 60, and the inner surfaces (left and right surfaces) of the second press-contact grooves 55 cut through the left and right side portions of the sheath 67 of the second cable 65. Thus, when the insulating housing 15 is maintained in the closed state, the inner surfaces (a pair of surfaces opposing each other) of the first press-contact grooves 53 evenly and reliably contact (clamp) both side portions of the core wire 61. Also, the inner surfaces (a pair of surfaces opposing each other) of the second press-contact grooves 55 evenly and reliably contact (clamp) both side portions of the core wire 66. Consequently, the core wire 61 of the first cable 60 and the core wire 66 of the second cable 65 are electrically connected to each other via the relay contact 50 within the branch connector 10.

Because the side portions of the core wire 61 and the side portions of the core wire 66 are not clamped in an excessively strong manner by the inner surfaces of the first press-contact grooves 53 and the inner surfaces of the second press-contact grooves 55, parts of the core wire 61 and the core wire 66 are not cut by the first press-contact grooves 53 and the second press-contact grooves 55, respectively. Thus, the core wire 61 and the core wire 66 maintain the respective mechanical strength, thereby reducing the likelihood that the core wires 61 and 66 are completely severed by tensile forces applied to the first cable 60 and the second cable 65. This can improve reliable contact between the first cable 60, the second cable 65, and the relay contact 50.

In a state in which the first split housing 16 and the second split housing 30 are closed (fitted together) and held (locked), the opposing surface 21*a* of the cover portion 21 of the first split housing 16 partially closes the openings (the top openings in FIG. 4) of the first cable holding groove 35*a* and the second cable holding groove 35*b*, and the opposing surface 22*a* of the cover portion 22 of the first split housing 16 partially closes the openings of the first cable holding groove 36*a* and the second cable holding groove 36*b*. As illustrated in FIG. 10, the first cable 60 is clamped in the up-down direction by the pair of inclined surfaces 19*a* of the first split housing 16 and the inclined surfaces 35*e* and 36*e* of the second split housing 30. In particular, the first cable 60 is held by the first cable mounting groove 19 of the first split housing 16 on the front side and the outer edge portion of the inclined surface 35*e* of the second split housing 30, and by the first cable mounting groove 19 on the rear side and the outer edge portion of the inclined surface 36*e* of the second split housing 30. That is, each of the first cable mounting grooves 19 serves as a first holding portion 29 configured to hold the first cable 60. Similarly, each of the outer edge portions of the inclined surfaces 35*e* and 36*e* serves as a second holding portion 44 configured to hold the first cable 60. Corresponding surfaces of the first cable 60 abut the first holding portion 29 and the second holding portion 44. The first cable 60 is clamped in the up-down direction by the inclined surfaces 19*a* of the first split housing 16 and the inclined surfaces 35*e* and 36*e* of the second split housing 30 between the first holding portions 29 and the second holding portions 44. A similar configuration applies to the second cable 65. That is, each of the second cable mounting grooves 20 serves as the first holding portion 29, and each of the outer edge portions of the inclined surfaces 35*f* and 36*f* serves as the second holding portion 44. In the following description, the first holding portion 29 and the second holding portion 44 located on the rear side of the first cable 60 will be described. A similar description also applies to the front side of the first cable 60 and the front and rear sides of the second cable 65.

As illustrated in FIG. 10, in a state in which the first split housing 16 and the second split housing 30 are fitted together, the location of the first holding portion 29 and the location of the second holding portion 44 are different from each other in the extending direction of the first cable 60, i.e., in the front-rear direction. The location of the first holding portion 29 and the location of the second holding portion 44 are different from each other also in a direction perpendicular to the extending direction of the first cable 60, i.e., in the up-down direction. In particular, the position of the second holding portion 44 is located outside of the position of the first holding portion 29 with respect to the front-rear direction. The position of the second holding portion 44 is located above the position of the first holding portion 29 with respect to the up-down direction. The contact points between the first cable 60 and the first press-contact grooves 53 are located above the first holding portion 29 and the second holding portion 44 with respect to the up-down direction. That is, the contact points of the first cable 60 in contact with the first press-contact groove 53, the second holding portion 44, and the first holding portion 29 are located from up to down in the stated order along the up-down direction (in the clamping direction). In other words, the first cable 60 is bent downward from the vicinity of the first holding portion 29 to the vicinity of the second holding portion 44 and positioned lower than the contact points between the first cable 60 and the first press-contact grooves 53.

The first holding portion 29 holds the first cable 60 in a first direction, e.g., a direction (an upward direction) opposite to the pressing direction of the first cable 60. The second holding portion 44 holds the first cable 60 in a second direction, e.g., the pressing direction (a downward direction) of the first cable 60. A first gap 29*a* is formed on the opposite side of the first cable 60 in the first direction. A second gap 44*a* is formed on the opposite side of the first cable 60 in the second direction. That is, the first gap 29*a* is formed on the first cable 60, and the second gap 44*a* is formed under the first cable 60.

Hereinafter, the branch connector 10 in a state provided with fillers 70 will be mainly described. Each of the fillers 70 may be any appropriate material including a waterproof gel, a UV curing resin, and an adhesive. Hereinafter, the fillers 70 are described as waterproof members 70 each of which is configured as a waterproof gel or a UV curing resin capable of realizing a waterproofing function.

Figure 11:
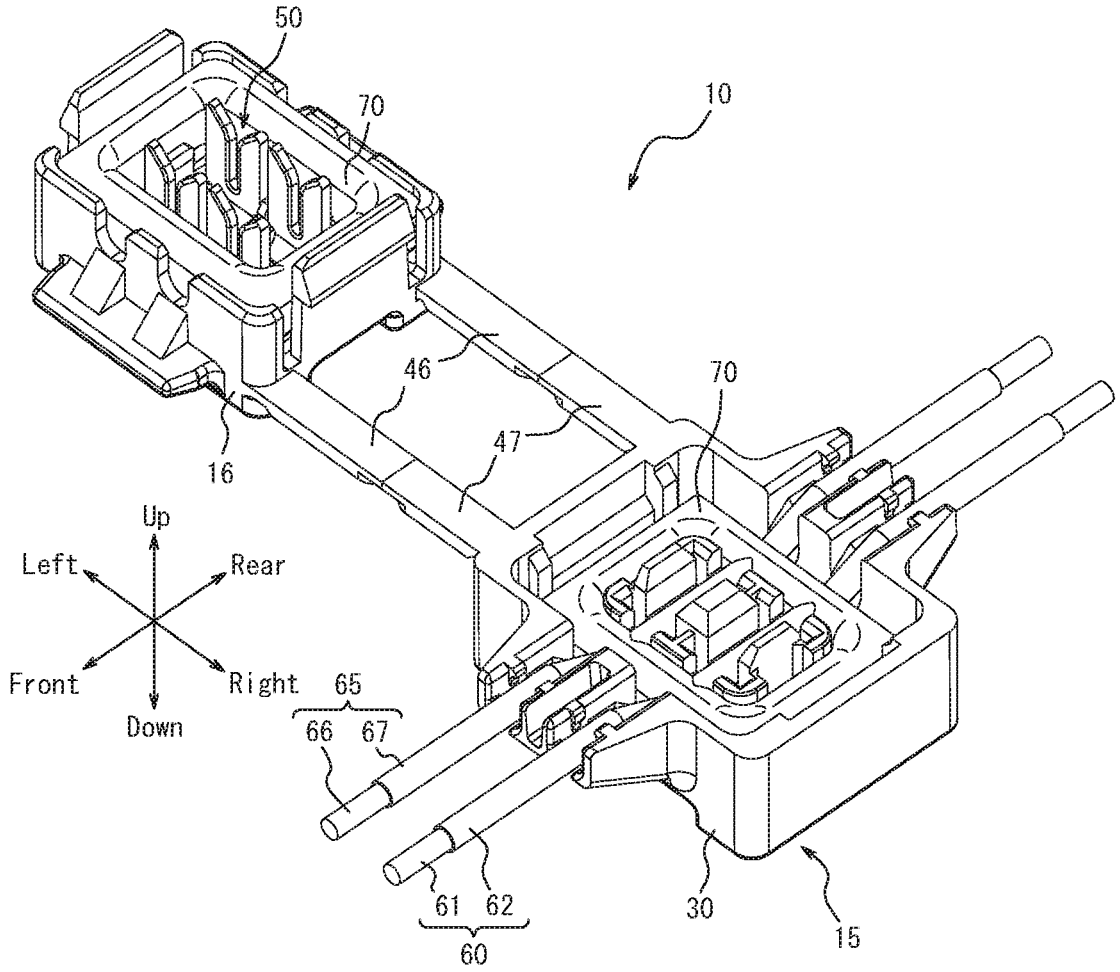
FIG. 11 is a perspective view illustrating a state in which a waterproof member is mounted in the insulating housing in the open state.
Figure 12:
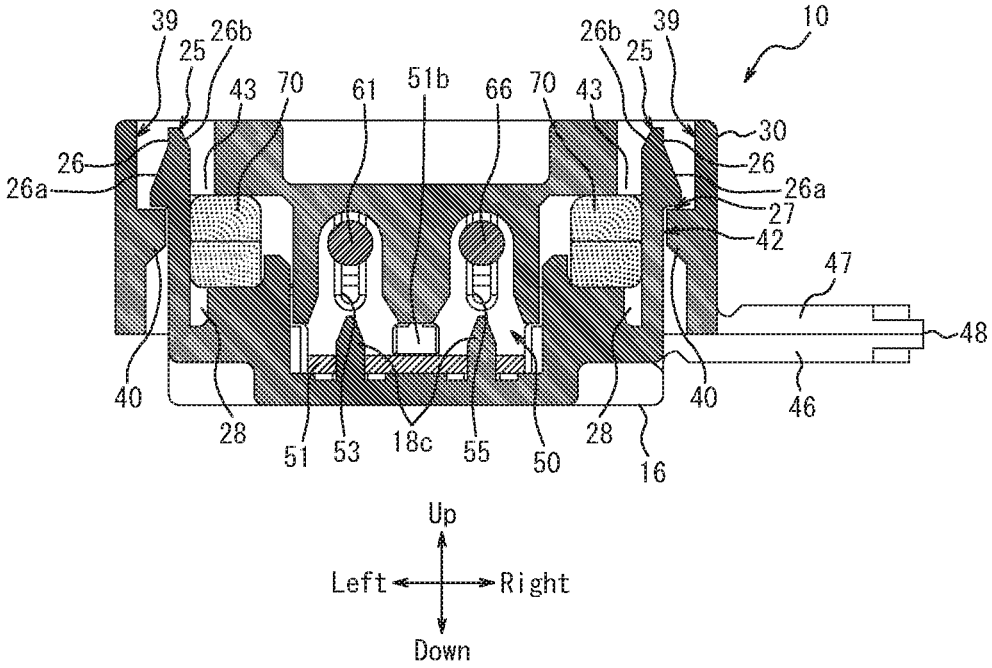
FIG. 12 is a cross-sectional view illustrating a locked state of the branch connector having the waterproof member mounted therein corresponding to FIG. 9.
Figure 13:
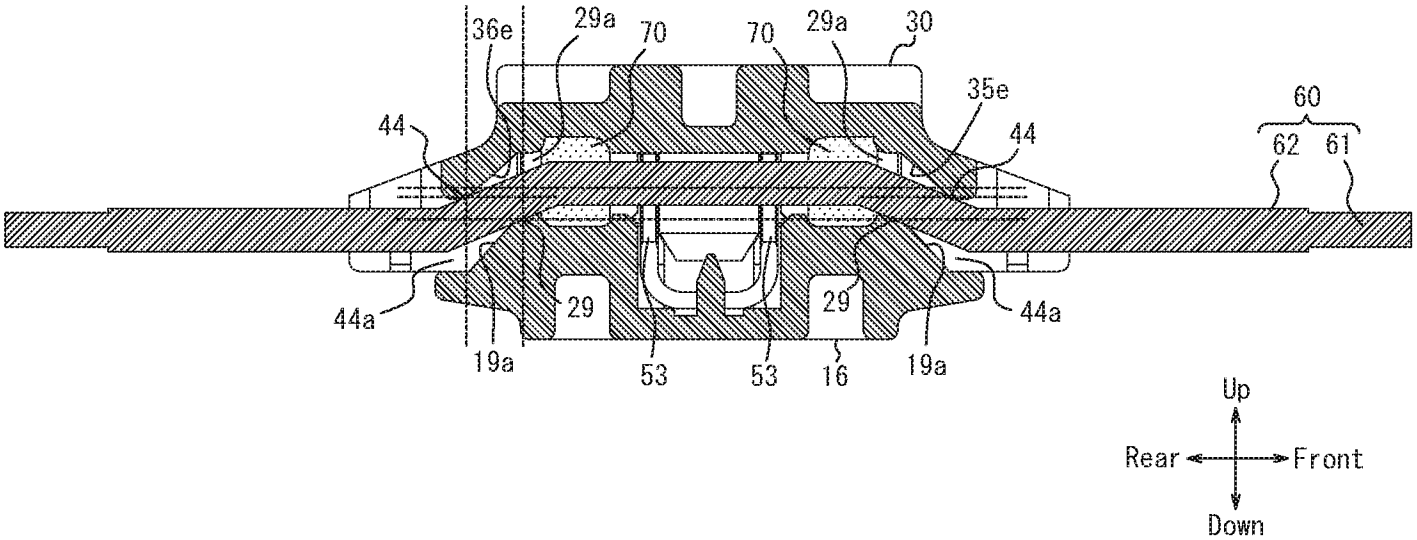
FIG. 13 is a cross-sectional view illustrating the locked state of the branch connector having the waterproof member mounted therein corresponding to FIG. 10.

FIG. 11 is a perspective view illustrating an expanded state in which the insulating housing 15 is provided with the waterproof members 70. FIG. 12 is a cross-sectional view illustrating a locked state in which the branch connector 10 is provided with the waterproof members 70 corresponding to FIG. 9. FIG. 13 is a cross-sectional view illustrating a locked state in which the branch connector 10 is provided with the waterproof members 70 corresponding to FIG. 10.

In one embodiment, the waterproof members 70 are provided on the inner circumferential first opposing surface 17*b* of the first split housing 16 and the inner circumferential second opposing surface 31*b* of the second split housing 30, as illustrated in FIG. 11.

The waterproof member 70 provided on the inner circumferential first opposing surface 17*b* of the first split housing 16 includes a bottom surface having a planar shape in substantial conformance with the inner circumferential first opposing surface 17*b*, and has a rectangular tubular shape surrounding the relay contact 50. The height of this waterproof member 70 is determined such that the waterproof members 70 come into tight contact with each other when the first split housing 16 and the second split housing 30 are closed.

The waterproof member 70 provided on the inner circumferential second opposing surface 31*b* of the second split housing 30 includes a bottom surface having a planar shape in substantial conformance with the inner circumferential second opposing surface 31*b*, and has a rectangular tubular shape surrounding the relay contact 50. The height of this waterproof member 70 is determined such that the waterproof members 70 come into tight contact with each other when the first split housing 16 and the second split housing 30 are closed.

When the branch connector 10 is transitioned to the locked state from the expanded state illustrated in FIG. 11, the entire interior of the first split housing 16 and the entire interior of the second split housing 30 fitted together are filled with the respective waterproof members 70, as illustrated in FIG. 12. In particular, when the first split housing 16 and the second split housing 30 are brought into the locked state, the waterproof members 70 tightly contact with the inner circumferential first opposing surface 17*b* and the inner circumferential second opposing surface 31*b* and thus seal the periphery of the relay contact 50. The waterproof members 70 surround the surface of the sheath 62 of the first cable 60 and the surface of the sheath 67 of the second cable 65 (without interfering with the electrical connection to the relay contact 50). As illustrated in FIG. 13, each of the waterproof members 70 provided in the first split housing 16 and the second split housing 30 is located between the relay contact 50 and the first holding portion 29.

The first split housing 16 and the second split housing 30 include a pair of spaces 28 and a pair of spaces 43, respectively, for accommodating excessive portions of the fillers 70. In a state in which the first split housing 16 and the second split housing 30 are fitted together, the spaces 28 and the spaces 43 extend along the inner surfaces of the pair of first locking portions 25, and the spaces 28 are located under the fillers 70 while the spaces 43 are located above the fillers 70. Thus, the spaces 28 and the spaces 43 can store the excessive portions of the fillers 70 in the locked state. Consequently, the branch connector 10 can accommodate a difference between pressing forces applied to the first cable 60 and the second cable 65.

The waterproof members 70 abut the inner surfaces of the pair of first locking portions 25 of the first split housing 16. Preferably, each of the engaging surfaces 27 of the first locking protrusion 26 and the second locking protrusion 40 is located, with respect to the up-down direction thereof, within the up-down direction width of the waterproof members 70, as illustrated in FIG. 12. When the first split housing 16 and the second split housing 30 are fitted together, the surface of the second locking protrusion 40 abuts the outer surface of the first locking portion 25. Each of abutment surfaces 42 thus formed is preferably configured to be substantially parallel to the inner surface of the first locking portion 25 abutting the waterproof member 70.

The waterproof members 70 configured as described above can reduce the risk that water or dust contacts the core wire 61 of the first cable 60 and the core wire 66 of the second cable 65.

Because the waterproof members 70 closely contact with the first cable 60 and the second cable 65, the waterproof members 70 can maintain reliable contact even if the first cable 60 and the second cable 65 are shaken and bent by an external force applied to the outside of the branch connector 10. In other words, transmission of a movement or stress caused by the bend of the first cable 60 and the second cable 65 to clamped portions thereof clamped by the relay contact 50 is inhibited.

Because the waterproof members 70 abut the inner surfaces of the pair of first locking portions 25, the first locking portion 25 having resiliency is elastically deformed outward by an elastic force acting from the inside to the outside caused by the expansion or swelling of the waterproof members 70. Because the branch connector 10 includes the locking portions formed therein, the branch connector 10 can enable further stronger engagement between the first locking portion 25 and the second locking portion 39 by their outward elastic deformation. In particular, because of the engaging surfaces 27 of the first locking protrusions 26 and the second locking protrusions 40 are located within the up-down-direction width of the inner surface of the first locking portion 25 abutting the waterproof member 70, an expansion force or the like of the waterproof members 70 is efficiently converted into an engaging force. Because the abutment surfaces 42 are substantially parallel to the inner surfaces of the pair of first locking portions 25 abutting the waterproof member 70, the expansion force and the like of the waterproof members 70 is transmitted to the surfaces of the first locking portion 25 and the second locking protrusion 40 in a direction substantially perpendicular thereto. This enables further efficient conversion of the expansion force or the like of the waterproof members 70 into the engaging force. Consequently, the branch connector 10 can further strengthen the close contact between the first split housing 16 and the second split housing 30. Thus, in a state in which an elastic force acts from the inside to the outside, the branch connector 10 can inhibit opening of the first split housing 16 and the second split housing 30. In this way, the branch connector 10 can maintain the waterproof property. Although the effect as described above is demonstrated at a room temperature, the effect becomes more noticeable at high temperature when expansion of the waterproof members 70 is greater.

When a high viscosity member is used as the waterproof members 70, the branch connector 10 can inhibit the opening of the first split housing 16 and the second split housing 30 more effectively. That is, when the waterproof members 70 are provided to the first split housing 16 and the second split housing 30, the waterproof members 70 stick to each other in the locked state. An adhesive force thus generated acts as a force resisting against the opening of the first split housing 16 and the second split housing 30 when fitted together.

Because the branch connector 10 includes the locking mechanism inside the first split housing 16 and the second split housing 30 fitted together, the outer peripheral wall 31 can be formed in a substantially planar shape with less unevenness or through holes. This enables the branch connector 10 to have an improved waterproof property and to inhibit penetration of foreign substances such as dust and oil.

When the pair of first locking protrusions 26 extending in one direction and the pair of second locking protrusions 40 extending in the same direction are engaged with one another, the engaging surfaces 27 configured as flat surfaces extending in the same direction are formed. Thus, the engaging surface 27 of the branch connector 10 can have a large area and thus strengthen the engagement. Because the engaging surfaces 27 in the branch connector 10 are substantially horizontal as illustrated in FIG. 12, the engaging force can be easily transmitted between the first locking protrusion 26 and the second locking protrusion 40. Thus, the first locking protrusion 26 and the second locking protrusion 40 of the branch connector 10 can have larger widths than those of conventional locking portions formed externally. This further increases a locking force and strengthens the locking. Because the strengths of the first locking portion 25 and the second locking portion 39 themselves are also increased, the branch connector 10 can inhibit damages to the locking portions.

The inclined surface 26*b* provided to each of the first locking portions 25 of the branch connector 10 can inhibit the tip of the first locking portion 25 from being pushed into, or scraping, the waterproof members 70 when the first split housing 16 and the second split housing 30 are fitted together.

When the first split housing 16 and the second split housing 30 are in the closed state, the branch connector 10 allows the first cable 60 and the second cable 65 to be bent in such a manner that holding positions thereof are displaced from one another in the front-rear direction and up-down direction. Thus, the branch connector 10 can maintain the sealing property for cables with different specifications. That is, a conventional mechanism configured to clamp cables in the same positions forms gaps between the mechanism and the cables when the diameters of the cables do not match the size of the mechanism. However, the branch connector 10 includes the first gap 29*a* and the second gap 44*a* formed due to the positional deviations between the first holding portions 29 and the second holding portions 44 in the front-rear direction and the up-down direction, and thus can accommodate various differences caused by cables with different specifications. For example, the branch connector 10 can accommodate differences between cable diameters, sheath materials, hardness, stretching ratios, thicknesses, and so on. Because the first holding portions 29 and the second holding portions 44 reliably hold the first cable 60 and the second cable 65 at two locations on each side in opposite directions, the branch connector 10 can have an improved sealing property. Thus, the branch connector 10 can have an improved waterproofing property.

Each of the first cable 60 and second cable 65 is bent in the downward direction, and the second holding portions 44 positioned on the outside of bending portions hold the cables in the downward direction from above the cables as illustrated in FIG. 13. Thus, the branch connector 10 can reduce an impact of an external force. That is, the branch connector 10 inhibits the transmission of the movement or stress of the bend of the first cable 60 and the second cable 65 caused by an external force to the clamped portion clamped by the relay contact 50. Because the cable supporting arms 35 and 36 are formed on the outside of the second holding portions 44, the branch connector 10 can further suppress an impact of an external force and improve the reliable contact.

Because the waterproof members 70 surround the clamped portion in an area inside of the first holding portion 29 where the first cable 60 and the second cable 65 are less bent, the branch connector 10 has an excellent waterproof property. Because each of the first holding portions 29 are formed by the first cable mounting grooves 19 and the second cable mounting grooves 20 having semicircular shapes, gaps between the first holding portions 29 and surfaces of the cables having a circular shape can be filled. Thus, the waterproof property can be improved.

It will be apparent to those who are skilled in the art that the present disclosure may be realized in forms other than the embodiment described above, without departing from the spirit and the fundamental characteristics of the present disclosure. Accordingly, the foregoing description is merely illustrative and not limiting in any manner. The scope of the present disclosure is defined by the appended claims, not by the foregoing description. Among all modifications, those within a range of the equivalent to the present disclosure shall be considered as being included in the present disclosure.

Figure 14:
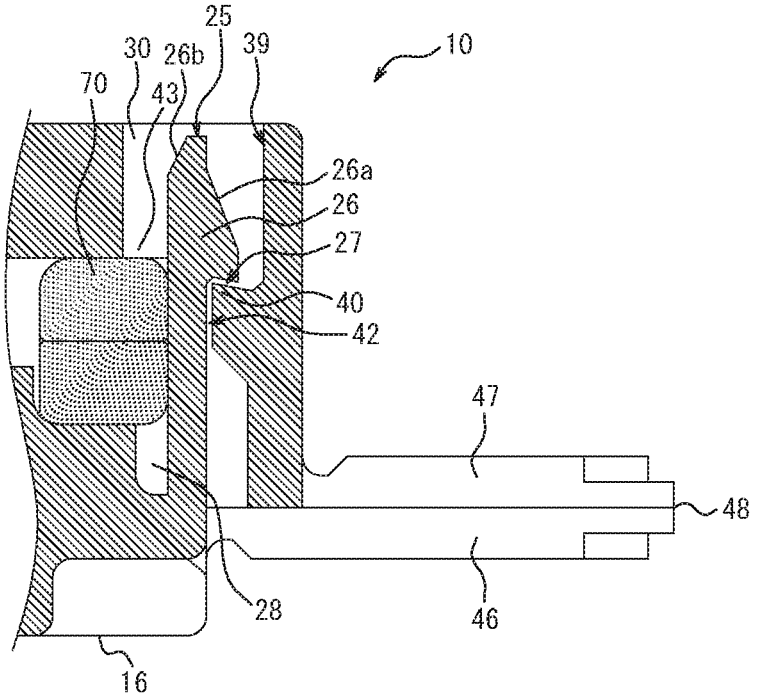
FIG. 14 is a partial enlarged view illustrating an engaging portion of the first locking portion and the second locking portion according to a variation example corresponding to FIG. 12.

FIG. 14 is an enlarged cross-sectional view illustrating an engaging portion between the first locking portion 25 and the second locking portion 39 corresponding to FIG. 12 according to an example variation. In the above embodiment, each of the engaging surfaces 27 between the first locking protrusion 26 and the second locking protrusion 40 is a horizontal flat surface extending in the front-rear direction. However, this is not restrictive. For example, each of the engaging surfaces 27 may be inclined downward toward the outside from the inside of the first split housing 16 and the second split housing 30 fitted together as illustrated in FIG. 14. This cross-sectional shape can further reduce the likelihood of disengagement.

Although the first locking portions 25 are formed in the first split housing 16 and the second locking portions 39 are formed in the second split housing 30 in the above embodiment, this is not restrictive. The first locking portions 25 having resiliency may be formed in the second split housing 30 that does not include the relay contacts 50. The second locking portions 39 may be formed in the first split housing 16 that includes the relay contact 50. The positions of the first locking portions 25 and the second locking portions 39 in the first split housing 16 and the second split housing 30 are not limited to the above description. The first locking portions 25 and the second locking portions 39 may be formed in any position capable of engaging the first split housing 16 and the second split housing 30 together and securing the locked state.

In the above embodiment, the first locking portions 25 and the second locking portions 39 include the first locking protrusions 26 and the second locking protrusions 40, respectively, which function as locking means. However, this is not restrictive. The first locking portions 25 and the second locking portions 39 may be locked to each other in any appropriate manner.

In the above embodiment, the pair of retainer protrusions 35*c* and the pair of retainer protrusions 36*c* configured to inhibit the first cable 60 from coming off are provided to the first cable holding groove 35*a* and first cable holding groove 36*a*, respectively, and the pair of retainer protrusions 35*d* and the pair of retainer protrusions 36*d* configured to inhibit the second cable 65 from coming off are provided to the second cable holding groove 35*b* and the second cable holding groove 36*b*, respectively. The retainer protrusions may be provided to each of the first pressing groove 32*a* and the second pressing groove 32*b* of the cable pressing protrusion 32.

Although the relay contact 50 is configured to clamp the second cable 65 in the above embodiment, the relay contact 50 may be configured to crimp the second cable 65. In this case, the second cable 65 is connected in a crimped manner to the relay contact 50 in advance and, in this state, the relay contact 50 is mounted in the first split housing 16. In this embodiment, cable crimp terminals are formed in place of one of the pair of first press-contact grooves 53 and the pair of second press-contact grooves 55 of the relay contact 50. The second split housing 30 is provided with the cable supporting arm 35 or 36 corresponding to the remaining one of the press-contact grooves.

The branch connector 10 may connect three or more cables together that are arranged in a direction orthogonal to or substantially orthogonal to the extending direction of the portions of the cables supported by the branch connector 10. In this case, a relay contact may include a set of three or more press-contact grooves (arranged in the left-right direction). A plurality of relay contacts may include the respective press-contact grooves. At least one of the plurality of relay contacts includes two or more press-contact grooves, each of which is configured to clamp a cable (a core wire).

In the above embodiment, the first holding portions 29 hold the first cable 60 in the direction opposite to the clamping direction, and the second holding portions 44 hold the second cable 65 in the clamping direction. However, this is not restrictive. Each of the first holding portions 29 and the second holding portions 44 may hold the cable in any direction capable of holding the respective cables securing the sealing state. The positions of the contact points between the first cable 60 and the first press-contact grooves 53 and the positions of the contact points between the second cable 65 and the second press-contact grooves 55 with respect to the up-down direction may be the same as the positions of the second holding portion 44 with respect to the up-down direction.

REFERENCE SIGNS LIST

10 branch connector
15 insulating housing
16 first split housing
17 outer peripheral wall
17*a* inner circumferential recess
17*b* inner circumferential first opposing surface
17*c* first central recess
17*d* first central opposing surface
18 contact mounting groove
18*a* fixing portion
18*b* central protrusion
18*c* positioning protrusion
19 first cable mounting groove
19*a* inclined surface
20 second cable mounting groove
20*a* inclined surface
21, 22 cover portion
21*a*, 22*a* opposing surface
25 first locking portion
25*a* recess
26 first locking protrusion
26*a*, 26*b* inclined surface
27 engaging surface
28 space
29 first holding portion
29*a* first gap
30 second split housing
31 outer peripheral wall
31*a* inner circumferential recess
31*b* inner circumferential second opposing surface
32 cable pressing protrusion
32*a* first pressing groove
32*b* second pressing groove
32*c* central protrusion
32*d*, 32*e* protrusion
35, 36 cable supporting arm
35*a*, 36*a* first cable holding groove
35*b*, 36*b* second cable holding groove
35*c*, 36*c* retainer protrusion
35*d*, 36*d* retainer protrusion
35*e*, 36*e* inclined surface
35*f*, 36*f* inclined surface
37*a*, 37*b*, 38*a*, 38*b* protruding member
39 second locking portion
40 second locking protrusion
41 convex wall
42 abutting surface
43 space
44 second holding portion
44*a* second gap
46 first connecting portion (connecting portion)
47 second connecting portion (connecting portion)
48 fold-facilitating portion
50 relay contact
51 base
51*a* positioning hole
51*b* space
52 first cable clamp member
52*a* top end portion
52*b* narrow portion
53 first press-contact groove (clamp groove)
54 second cable clamp member
54*a* top end portion
54*b* narrow portion
55 second press-contact groove (clamp groove)
60 first cable (cable)
61 core wire
62 sheath
65 second cable (cable)
66 core wire
67 sheath
70 waterproof member (filler)

The invention claimed is:

1. A branch connector configured to electrically connect cables by cutting an insulating sheath in press-contact grooves, said branch connector comprising:

a pair of a first split housing and a second split housing that are coupled to each other via a connecting portion and capable of opening and closing;

first holding portions that are provided to said first split housing and configured to hold said cables; and second holding portions that are provided to said second split housing and configured to hold said cables, wherein, in a state in which said first split housing and said second split housing are fitted together, locations of said first holding portions and locations of said second holding portions are different from each other with respect to an extending direction of said cables and a direction perpendicular to said extending direction, and wherein, in a state in which said first split housing and said second split housing are fitted together, said first holding portions hold said cables in a first direction such that first gaps are formed on an opposite side of said cables in said first direction, and the second holding portions hold said cables in a second direction such that second gaps are formed on an opposite side of said cables in said second direction.

2. The branch connector according to claim 1, wherein said first direction is opposite to a pressing direction for pressing said cables against said press-contact grooves, and said second direction is said pressing direction.

3. The branch connector according to claim 2, wherein, in a state in which said first split housing and said second split housing are fitted together, said cables are bent from portions near said first holding portions to portions near said second holding portions in said pressing direction further than contact points between said cables and said press-contact grooves.

4. The branch connector according to claim 3, wherein, in a state in which said first split housing and said second split housing are fitted together, said contact points, said second holding portions, and said first holding portions are arranged in the stated order in said pressing direction.

5. The branch connector according to claim 1, wherein, in a state in which said first split housing and said second split housing are fitted together, said second holding portions are located on outside of said first holding portions with respect to said extending direction.

6. A branch connector configured to electrically connect cables by cutting an insulating sheath in press-contact grooves, said branch connector comprising:

a pair of a first split housing and a second split housing that are coupled to each other via a connecting portion and capable of opening and closing;

first holding portions that are provided to said first split housing and configured to hold said cables;

second holding portions that are provided to said second split housing and configured to hold said cables; and a relay contact having said press-contact grooves, wherein, in a state in which said first split housing and said second split housing are fitted together, locations of said first holding portions and locations of said second holding portions are different from each other with respect to an extending direction of said cables and a direction perpendicular to said extending direction, and wherein, in a state in which said first split housing and said second split housing are fitted together, each of a filler provided in said first split housing and a filler provided in said second split housing is located between said relay contact and said first holding portions.

* * * * *